US005121893A

United States Patent [19]

King et al.

[11] Patent Number: 5,121,893

[45] Date of Patent: Jun. 16, 1992

[54] WINDOW BLIND LOW PROFILE MOUNTING BRACKET

[75] Inventors: Robert N. King, Sunnyvale; Alan R. Sternquist, Pleasanton; Douglas J. Warner, Albany, all of Calif.

[73] Assignee: Levolor Corporation, Sunnyvale, Calif.

[21] Appl. No.: 682,837

[22] Filed: Apr. 9, 1991

[51] Int. Cl.[5] ..... A47H 1/00

[52] U.S. Cl. ..... 248/251; 248/222.1; 248/221.3; 248/231.2; 160/902

[58] Field of Search ..... 248/251, 544, 222.1, 248/221.3, 231.2, 316.4; 160/902, 178.1

[56] References Cited

U.S. PATENT DOCUMENTS 4,718,625 1/1988 Boda ..... 248/222.1

4,909,926 8/1990 Liu ..... 248/251

*Primary Examiner*—Alvin C. Chin-Shue

*Attorney, Agent, or Firm*—Skjerven, Morrill, MacPherson, Franklin & Friel

[57] ABSTRACT

A pair or more of three-piece brackets (20) are provided for mounting the longitudinal edges of a window blind headrail (11). Each bracket includes a frame (21) with apertures (22) for mounting to a window frame top or ceiling (15). The frame (20) includes spaced depending apertured tabs (24, 25) through which a slidable tongue (30) is positioned. The distal ends (41) of an arrow spring (40) are confined by tangs (31) on tongue (30) and the other spring end (42) abuts and is confined by a notch (39) in tab (25). A top front lip (12) of the headrail (11) is tilted and positioned on the tongue (30) and then pushed inwardly to move the tongue (30) and compress spring (40) which allows the top rear lip (14) of the headrail (11) to rotate and clear a lip portion (**25*b*) of tab (25) to a position within the lip portion (25*b*). Release of the pushing force releases the spring energy, forcing the tongue (30) back so that the headrail (11) is clamped between tongue (30) and tab (25). Bifurcated ramped legs (32) on one end of the tongue (30**) prevent disassembly of the bracket.

11 Claims, 4 Drawing Sheets

WINDOW BLIND LOW PROFILE MOUNTING BRACKET

FIELD OF THE INVENTION

This invention is directed to a support bracket for mounting a headrail of a venetian or other type blind where the blind is typically mounted at the top of a window frame or ceiling. More particularly the invention pertains to a spring-movable latch bracket for holding front and back longitudinal top edges of a blind headrail.

BACKGROUND OF THE INVENTION

Previously venetian blinds in which a series of horizontal blind slats extend downwardly in a vertical array from a headrail, have been mounted by headrail end brackets as exemplified in U.S. Pat. No. 2,231,778. Other box-like end brackets overlapping the headrail have been employed. U.S. Pat. No. 2,698,727 discloses brackets with outwardly-facing lips receiving inwardly-facing front and rear longitudinal upper edges of the headrail, the headrail having sufficient flexibility to allow mounting. U.S. Pat. No. 4,235,406 illustrates a form of a single bracket hook and shelf which captures the edges of a headrail. U.S. Pat. No. 4,411,401 shows a bracket having an integral spring tongue for supporting one headrail edge and a fixed hook end. This patent along with U.S. Pat. No. 4,607,818 also shows an adapter for mounting a bracket to a vertical window portion U.S. Pat. No. 4,802,644 illustrates a two-part bracket in which a main body is secured to wall or ceiling and a separate member has limited horizontal movement therewith and includes resilient legs and a U-shaped tongue with a portion extending forwardly of the front rim of the headrail to allow a tool (screwdriver) to be inserted to disengage the headrail rim. The overall bracket is about the height of the headrail. U.S. Pat. No. 4,938,443 shows another two-part bracket having a resilient inner headrail support and a wall-mountable outer support.

Each of the various above-described brackets is generally of high profile and/or include elements which in part are observable in the headrail "installed" condition. Some can only be installed on a vertical wall or require a tool for disassembly. Others create an unsightly clearance between the headrail top and the window frame top or room ceiling. Lastly, most of the prior high profile brackets necessitate a dedication of a considerable volume of the headrail internal volume for the brackets.

SUMMARY OF THE INVENTION

The present invention is basically a three-part bracket which is factory-assembled and shipped as an integral device to the installer or user. The bracket for a typical headrail having a 3.70 centimeter height and a 4.10 centimeter horizontal depth, is about 0.7 cm. in height hence it is characterized as being low-profile. The height of the bracket approximates only about 19% of total internal height of the headrail thus allowing a large headrail volume for mounting the slat tilt mechanism and device cord mechanisms within the headrail without interference from the brackets. An essentially flat frame is mountable direct to a horizontal window frame top or to a room ceiling or mounted to the top of a right angle adapter which has a vertical leg secured to an adjacent vertical wall. The flat frame includes a pair of integral depending bent tabs, one of which is formed with a horizontal distal end portion for supporting an elongated hook-like top edge of the headrail. Each of the tabs are apertured to receive a hanger tongue which is slidably movable horizontally in the aperture of each tab. The bracket is mounted transverse to the longitudinal top edges of the headrail. An essentially flat wire spring, such as a so-called one-piece arrow spring, is movably connected at its distal ends to the tongue and at the pointed opposed end of the spring abuts one of the tabs.

After a pair or more of the brackets have been mounted to a wall ceiling or window frame surface the front internally-facing upper longitudinal edge of the headrail is tilted by moving the headrail lower longitudinal edge forwardly and slightly upward and the front upper edge positioned on an upper surface end of the hanger tongue protruding from a first frame tab and is pushed against the end of the tongue. The tongue then moves rearwardly to compress the spring, allowing the rear internally-facing edge of the headrail to clear the other (second) tab and extend between the second tab and the other end of the tongue in a position so that the headrail can be rotated to a horizontal position onto the horizontal distal end portion of the second tab, when, upon release of the force on the headrail front, stored compression energy in the spring forces the headrail outwardly so that the tongue forward end pushes against the interior of the front top edge of the headrail and the rear top edge of the headrail abuts the rear depending tab of the bracket frame.

The above low-profile bracket construction and assembly provides for complete front concealment of the bracket within the headrail improving the aesthetics of the blind, minimizing the bracket-displacing volume in the headrail and eliminating the need for color-coordinating the brackets with the headrail. The brackets may be mounted at any position along the headrail length provided they do not interfere with the internal hardware of the headrail. For prevention of end-to-end motion of the headrail in a non-window frame installation one of the brackets is preferably mounted against a portion of the cord lock housing (not shown) fixed within the headrail which portion acts as a lateral stop. At least one bracket is preferably placed so as to be at a stud location for best holding of the bracket screws. No tools are needed for mounting or disassembling the headrail on the mounted brackets. The same bracket can be used for a vertical mount with use of a simple adapter. A minimum clearance between the headrail top and the ceiling or window frame top results in reducing the unsightly light gap created with box brackets and other of the brackets of the prior art.

DETAILED DESCRIPTION

Figure 1:
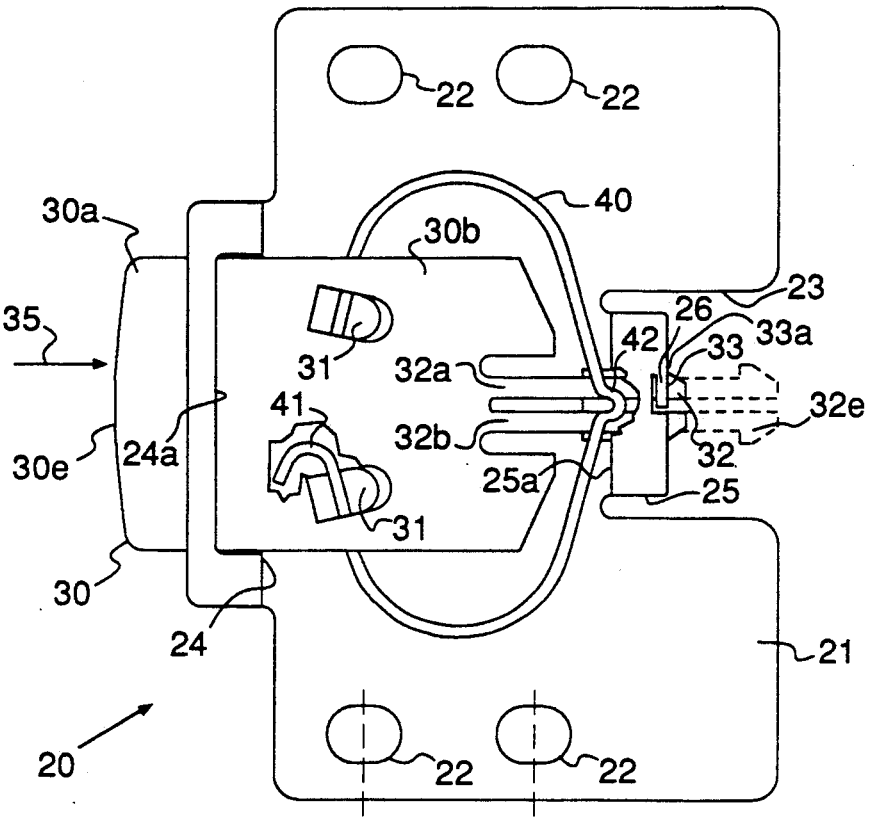
FIG. 1 is a bottom view of the bracket of the invention.

The three-part bracket 20 of the invention as seen in FIG. 1 includes a generally rectangular frame 21 made of flat sheet metal such as 1074 heat-treated steel to a Rockwell C hardness of 42–46 having a thickness of 1.2 mm and a hanger tongue 30 of the same material and thickness slidingly movable with respect to the frame 20 under spring-action of a one-piece arrow spring 40 extending between the frame 20 and the tongue 30. The frame has a series of through-apertures 22 for receipt of mounting screws 16 to mount the bracket on a window frame top portion or room ceiling 15 (FIG. 2) dependent on the surface to which a blind headrail is to be affixed.

The frame includes a pair of depending legs 24 and 25, leg 24 being bent from a side edge to the frame base and leg 25 being integrally formed by a bent portion of a frame edge cut-out 23. Each of the legs 24, 25 have through-apertures 24*a*, 25*a* respectively therein through which opposite ends of the hanger tongue 30 pass. Part of aperture 24*a* is in a horizontal distal end 24*h* of leg or tab 24.

Figure 2:
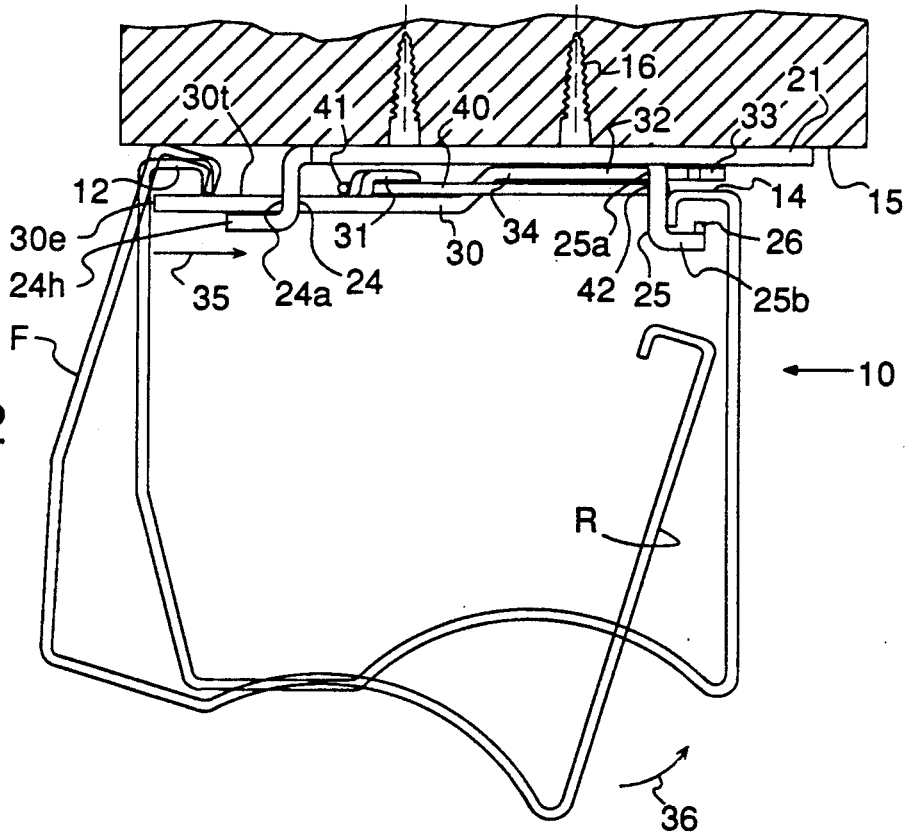
FIG. 2 is a schematic side elevational view showing the mounting of a headrail in the brackets.

One end 30*a* of the tongue 30 contains a pair of cut-out raised tangs 31 for capturing the curved distal ends 41 of spring 40. The other arrow end 42 abuts the edges of a small lower medial slot 39 (FIG. 5) in aperture 25*a* of tab 25. A cantilevered cut-out tab 26 in a horizontal distal lip 25*b* of tab 25 functions as an outer stop for the inserted rear longitudinal top edge of the headrail 10 (FIG. 2). The other end 30*b* of the tongue includes a cut-out forming a lock portion of bifurcated ramped legs 32. The pair of bifurcated spring legs 32*a* and 32*b* each have ramp surfaces 33 so that upon insertion of the legs into tab aperture 25*a* the legs are forced together permitting their passage through aperture 25*a*. Upon the ramped ends completing the passage, the legs spring back to their normal position so that reentrant portions 33*a* abut the vertical side edge(s) of the aperture 25*a* and thus prevent removal of the tongue 30 from tab 25. Upon a pushing force (arrow 35) on the end 30*e* of tongue 30, the spring 40 is compressed against fixed notch 39 (FIG. 5) and the bifurcated legs 32*a*, 32*b* moved rearwardly to the dashed line position.

The above pushing force 35 is provided as seen in FIG. 2 by tilting and pushing the front F of the headrail 11, more particularly by moving a top longitudinal top front hook portion 12 onto the top 30*t* of the tongue end 30*a* and pushing the inner essentially vertical part of the hook portion against the end surface 30*e* of the tongue. This moves the headrail and tongue 30 rearward and compresses the spring 40 so that the rear side R of the headrail 11 can be pivoted as shown by arrow 36 so that hook-like rear top elongated edge 14 of the headrail clears tab 25 and lip 25*b* thereof and seats within tab 25, its horizontal lip 25*b* and stop 26. Release of the pushing force by the installer releases the stored tension in spring 40 which forces tongue 30 to return to its original position forcing the headrail 11 outwardly into the room space and moving the interior surface of hook edge 14 to abut tab 25 to positively hold the headrail onto the bracket 20. The result is the headrail and bracket combination 10. The bracket frame 21 is shown as mounted on a window frame top portion 15 by screws 16 passing through frame apertures 22.

Figure 3:
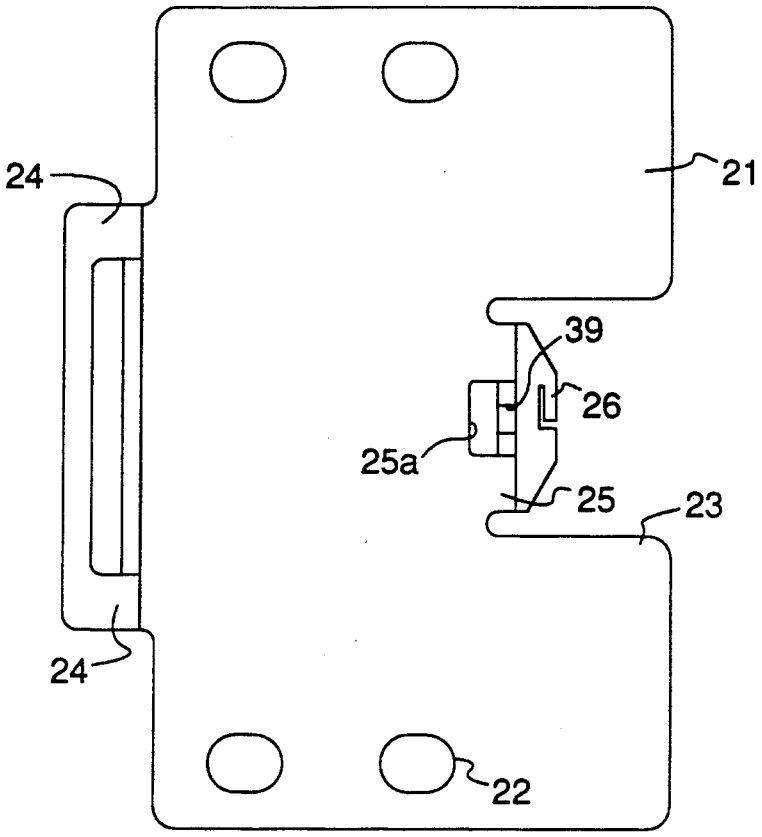
FIG. 3 is a bottom plan view of the bracket frame.

FIG. 3 shows the top side of frame 21 including tab 24 with aperture 24*a* and tab 25 with aperture 25*a*, the spring-holding notch 39 and the stop 26 in cut-out 23.

Figure 4:
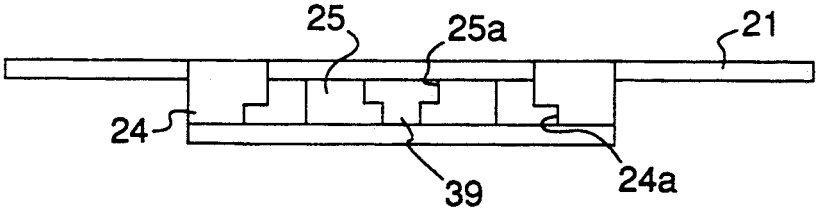
FIG. 4 is an end elevational of the frame showing the depending tabs.

FIG. 4 shows an upside down T-slot forming aperture 24*a* the cross-bar of the T supporting the range of movement of the tongue and being wide and high enough to allow during assembly, the passage of the tongue and its upstanding tangs 31 therethrough.

Figure 5:
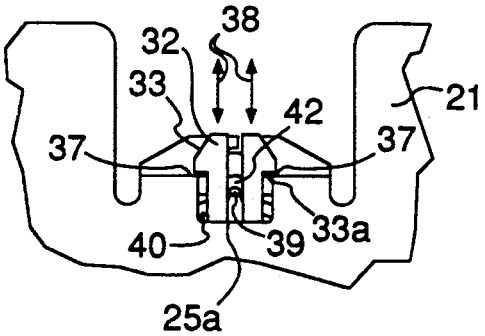
FIG. 5 is a detailed partial top plan view of the bracket showing the bifurcated legs of the bracket tongue captured by the frame tab.

FIG. 5 shows more clearly the back and forth movement (arrows 38) of lock portion 32 of the tongue where the reentrant portion 33*a* abuts an edge 37 of passage 25*a* in one-way stop abutment. The end 42 of spring 40 seats in and abuts notch 39.

Figure 6:
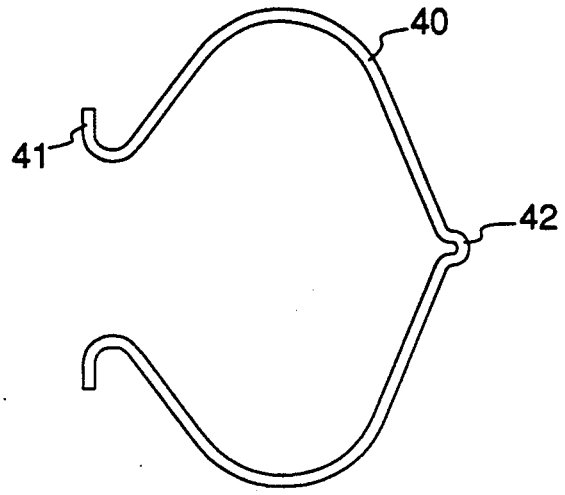
FIG. 6 is a plan view of the spring per se.
Figure 7:
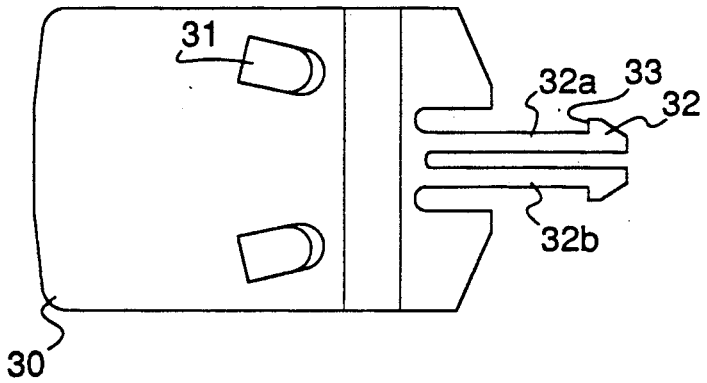
FIG. 7 is a plan top view of the bracket tongue per se.
Figure 8:
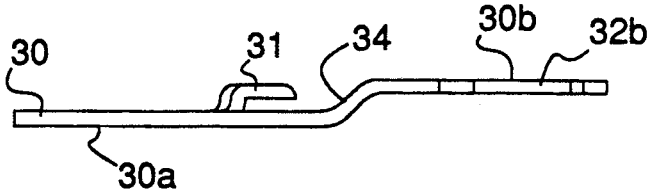
FIG. 8 is a side elevational view of the tongue per se.

FIGS. 6–8 show the spring 40 and hanger tongue 30 in full detail, particularly the bilevel nature of tongue 30 where end 30*a* is at a lower level than the end 30*b* with the ends integrally connected by medial portion 34. The wire gauge (typically 13 gauge music wire) may be changed to impart varying resistance to the expected applied force, depending on the perceived ease in mounting the headrail.

Figure 9:
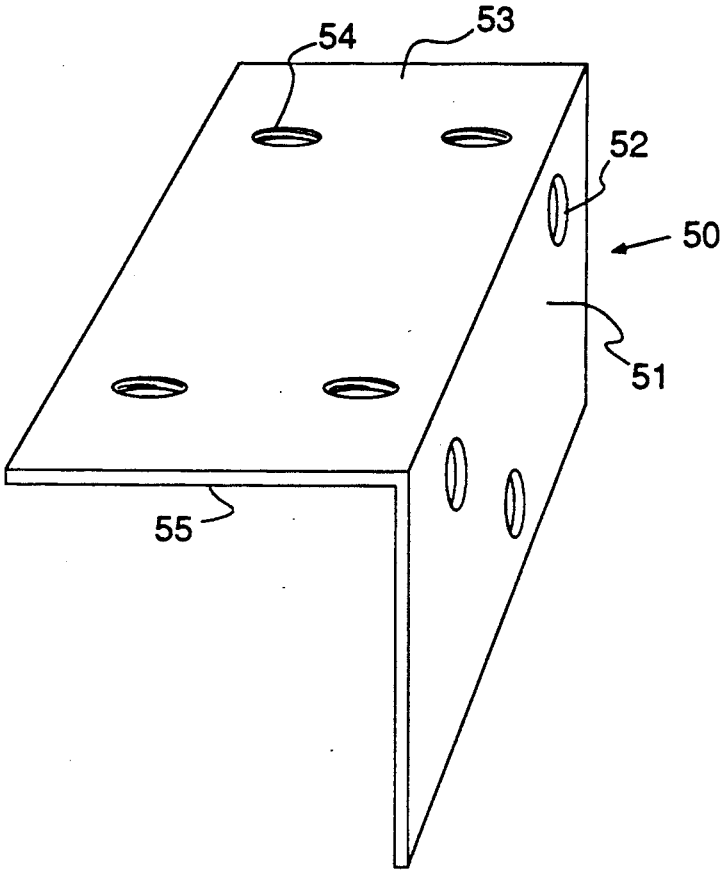
FIG. 9 is a perspective view of an adapter for vertical mounting of the bracket.

FIG. 9 shows a metal right angle adapter 50 having a vertical leg 51 with screw apertures 52 which leg is screw mountable to a vertical wall or vertical window frame portion, horizontal leg 53 which is positioned so that bracket frame 20 can be mounted underneath adapter 50 against surface 55. Self-tapping screws may be passed through frame apertures 22 into apertures 54 in horizontal leg 53 to hold the bracket securely to its adapter.

For removal purposes, the headrail rear is raised to clear tab stop 26 and the spring flexibility of spring 40 provides for sufficient rearward displacement of the bracket tongue to disengage the headrail from the rear hanger bracket. The headrail is then removed by downward rotation of the rear of the headrail followed by a forward pull to remove it from the bracket tongue.

The above description of the preferred embodiment of this invention is intended to be illustrative and not limiting. Other embodiments of this invention will be obvious to those skilled in the art in view of the above disclosure.

We claim:

1. A bracket for mounting a window blind, said blind including a headrail having facing first and second spaced hanger portions at top front and top back edges, said bracket comprising:

a flat frame including mounting apertures, said frame being mountable with respect to a horizontal mounting surface;

a first apertured tab integral with one end of said frame and extending downwardly therefrom;

a second apertured tab spaced from said first tab and integrally extending downwardly from said frame;

a hanger tongue slidingly movable on said frame and positioned in the apertures of said tabs, said tongue having end portions extending from said tabs; and a flat spring having one end connected to said hanger tongue and an opposite end abutting said second tab, such that in assembly the first headrail hanger portion engages an end of said hanger tongue extending from said first tab and when said first headrail hanger portion is moved said tongue is slid with respect to said frame to compress said spring and allows the second headrail hanger portion to seat on said second tab and wherein said compressed spring exerts pressure against said tongue to clamp said first and second headrail hanger portions to said bracket.

2. The bracket of claim 1 in which said spring is a one-piece arrow spring having free ends spacedly mounted on said tongue and an opposite pointed end abutting said second tab.

3. The bracket of claim 2 in which said tongue includes a pair of integral top tangs, said spring free ends being engageable with respective ones of said top tangs.

4. The bracket of claim 3 in which a top portion of said top tangs is slidable on a bottom surface of said frame and wherein said tongue includes a raised portion adjacent to said second tab slidable on said frame bottom surface, such that said tongue is movable in parallelism with said frame.

5. The bracket of claim 1 in which said hanger tongue includes a bifurcated end engageable with and captured by said second tab.

6. A low profile mounting bracket comprising:

a U-shaped base having apertured legs;

means for mounting the base to a mounting surface;

a tongue slidingly movable with respect to said base and extending through an aperture in each of said legs; and a spring having a first spring portion confined by said tongue and a second spaced spring portion abutting one of said base legs, such that first portion of an article to be mounted can be mounted across said base on a first tongue portion protruding from one of said legs and, upon movement of said first tongue portion toward the other of said legs and compression of said spring, a second portion of the article can be mounted on the other base leg.

7. The bracket of claim 6 in which base legs comprise integral tabs one extending downwardly from a first edge of said base and the other extending downwardly from inboard of an opposed second edge of said base, said other base leg including a horizontal distal end onto which said article second portion can be mounted.

8. The bracket of claim 6 further including means in said other base leg for preventing removal of the tongue from said other base leg.

9. The bracket of claim 8 in which said tongue includes a bifurcated end extending through said other base leg and wherein said means for preventing comprises a ramp and a reentrant portion on said bifurcated end allowing said bifurcated end in assembly to compress and expand into one-way stop abutment with respect to said other base leg.

10. The bracket of claim 6 in which the article is a blind headrail having a front and rear elongated top mounting edges, said front mounting edge forming said article first portion and said rear mounting edge forming said article second portion, such that said headrail edges extend between said first tongue portion and said other base leg.

11. The bracket of claim 10 further including means in said other base leg for preventing removal of the tongue from said other base leg and in which said tongue includes a bifurcated end extending through said other base leg and wherein said means for preventing comprises a ramp and a reentrant portion on said bifurcated end allowing said bifurcated end in assembly to compress and expand into one-way stop abutment with respect to said other base leg.

* * * * *